US005615437A

United States Patent [19]

Takahashi et al.

[11] Patent Number: 5,615,437

[45] Date of Patent: Apr. 1, 1997

[54] FLOOR-SURFACE POLISHER EQUIPPED WITH FUNCTION FOR ADJUSTING PAD PRESSURE

[75] Inventors: Shinichiro Takahashi; Eiji Nagayama, both of Miyakoda, Japan

[73] Assignee: Amano Corporation, Kanagawa-ken, Japan

[21] Appl. No.: 391,036

[22] Filed: Feb. 21, 1995

[30] Foreign Application Priority Data

Feb. 28, 1994 [JP] Japan ..... 6-054678

[51] Int. Cl.[6] ..... A47L 11/14

[52] U.S. Cl. ..... 15/98; 15/49.1; 15/319; 15/385; 451/11; 451/21; 451/353

[58] Field of Search ..... 15/49.1, 98, 319, 15/385; 451/11, 21, 24, 353

[56] References Cited

U.S. PATENT DOCUMENTS

| | | | |
|---|---|---|---|
| 3,496,681 | 2/1970 | Oswald | 15/49.1 |
| 4,674,142 | 6/1987 | Meili | 15/49.1 |
| 4,757,566 | 7/1988 | Field et al. | 15/49.1 |
| 4,910,824 | 3/1990 | Nagayama et al. | 15/98 |
| 5,177,828 | 1/1993 | Von Vett | 15/98 |
| 5,253,384 | 10/1993 | Joines et al. | 15/98 |

FOREIGN PATENT DOCUMENTS

| | | |
|---|---|---|
| 1-131634 | 1/1989 | Japan . |
| 4-93054 | 8/1992 | Japan . |

*Primary Examiner*—Mark Spisich
*Attorney, Agent, or Firm*—Watson, Cole, Stevens Davis P.L.L.C.

[57] ABSTRACT

In a floor-surface polisher in which floor-surface is polished by a pad which is mounted within a pad cover and rotated at a high speed by a motor during the traveling operation of the polisher, a floor-surface polisher equipped with a function for adjusting a pad pressure being characterized in that the pad is resiliently supported by a support force, the support force directing upwardly to separate the pad away from the floor-surface, a plurality of very small spaces being formed within the pad so that a drawing force for lowering the pad toward the floor-surface against the upwardly-directing support force will be generated during a high speed rotation of the pad, electric-current value setter for adjusting, either automatically or manually, an electric-current value of the motor to a pre-set value, the setter being mounted on a control portion of the pad motor.

4 Claims, 4 Drawing Sheets

NOTE: α IS AN ALLOWABLE VALUE TO BE PRESET

FLOOR-SURFACE POLISHER EQUIPPED WITH FUNCTION FOR ADJUSTING PAD PRESSURE

BACKGROUND OF THE INVENTION

1. Field of the Invention

This invention relates to a device for polishing floor-surface with a pad, which is rotated at a high speed by a motor, during the traveling operation of the device (this device will be hereinafter referred to as "floor polisher"), and more particularly to a floor-surface polisher equipped with a function for adjusting a pad pressure, in which a constant force for uniformly pressing the pad against floor-surface can be maintained (in other words, the pad can be uniformly intimately contacted with the floor-surface).

2. Brief Description of the Prior Art

A typical conventional floor-surface polisher of the type mentioned above has the problem in that a force for pressing the pad against the floor-surface is changed during operation, due to various causes such as wear of the pad, reduced voltage of the batteries, state of the floor-surface, and the like, and as a result, the quality level of the polishing job for the floor-surface is changed.

In view of the above, the inventor of the present invention has developed floor-surface polishers as discussed in previous Japanese Patent Application No. Sho 62-290363 (Japanese Laid-Open (KOKAI) Patent Application No. Hei 1-131640) and Japanese Utility Model Application No. Hei 2-405014 (Japanese Laid-Open (KOKAI) Utility Model Application No. Hei 4-93054), in which a pad is moved up and down by a motor, so that a force for pressing the pad against the floor-surface can be adjusted to normally maintain a constant level.

However, since the above conventional floor-surface polisher has a complicated mechanism for moving the pad up and down with the power of a motor, the cost becomes high. In addition, it is very difficult to maintain the pad pressure normally at a constant level by a motor. If the pad pressure is too strong, there is a possibility that the wax applied to the floor-surface comes off and the floor-surface applied with wax is scratched. In contrast, if the pad pressure is too weak, a sufficient polishing effect can not be obtained. Therefore, a solution is demanded.

The present invention has been accomplished in view of the above problems inherent in the conventional devices.

SUMMARY OF THE INVENTION

It is, therefore, an object of the present invention, to provide a floor-surface polisher equipped with a function for adjusting a pad pressure, in which a force for pressing a pad against floor-surface can be maintained normally at a constant level by adjusting the number of revolutions of a pad motor and without using a complicated structure for moving a pad up and down by a motor.

In order to achieve the above object, the present invention employs means as listed below, in a floor-surface polisher in which floor-surface is polished by a pad which is mounted within a pad cover and rotated at a high speed by a motor during the traveling operation of the polisher.

(1) The pad is resiliently supported by a support force, the support force directing upwardly to separate the pad away from the floor-surface, a plurality of very small spaces are formed within the pad so that a drawing force for lowering the pad toward the floor-surface against the upwardly-directing support force will be generated during a high speed rotation of the pad, and electric-current value adjusting means for adjusting, either automatically or manually, an electric-current value of the motor to a pre-set value being mounted on a control portion of the pad motor.

(2) The pad to be rotated at a high speed by the motor is upwardly resiliently supported by pad support means using selected one of a spring pressure, a hydraulic pressure, a pneumatic pressure, and a weight.

(3) The pad to be rotated at a high speed by the motor is formed into a construction in which a plurality of very small spaces exist within the pad, by subjecting a pad raw material to a compression molding or by forming a pad raw material into a sponge-like structure.

(4) An electric-current value setting portion capable of optionally setting an electric-current value of the motor is mounted on the control portion of the pad motor for rotating the pad at a high speed.

The above means (1) to (4) operate as follows.

According to the means of the above (1), since the pad surface is resiliently supported in such a manner as to be away from the floor surface when the floor-surface polisher is in a stopped state, there can be solved the problem in which the pad, this pad being rotating at a high speed during the stopped state of the polisher, peels off or scratches the wax applied to the floor-surface. Furthermore, since a plurality of very fine spaces are formed within the pad, air inside the pad is discharged outside when this pad is rotated at such a high speed as about 2,000 rpm by the motor and as a result, the internal pressure of the pad becomes negative. Therefore, since a drawing force is generated to a bottom surface of the pad with respect to the floor-surface, the pad is lowered by this drawing force toward the floor-surface against the upwardly-directing support force. Therefore, the pad drawn and attached to the floor-surface can polish the floor-surface by being rotated at a high speed in that state.

Also, according to the means of the above (2), when the pad is worn, the drawing force is lowered and the electric current value of the pad motor is lowered. However, when the electric-current value is lowered, the force for drawing and attaching the pad to the floor-surface can be increased and recovered by increasing the number of revolutions of the motor, either automatically or manually, by the electric-current adjusting means. Accordingly, even if the pad is worn, a constant pad pressure can be always maintained and an excellent polishing operation can be performed.

According to the means of the above (2), since the pad is upwardly resiliently supported by the pad support means using selected one of the spring pressure, the hydraulic pressure, the pneumatic pressure, and the weight, the pad can be pulled up to the state where the pad is separated away from the floor-surface when the floor-surface polisher is stopped in operation. Also, when the pad is being rotated at a high speed, the pad can be lowered toward the floor-surface so that the pad is drawn and attached to the floor-surface.

According to the means of the above (3), since the pad can be formed into a structure in which a plurality of very small spaces are formed within the pad, for example, by compression molding a polyester fiber or foam molding other raw materials into a sponge-like structure, the internal pressure of the pad becomes negative when the pad is being rotated at a high speed because air is discharged through those very small spaces. Accordingly, the pad can be effectively drawn and attached to the floor-surface.

According to the means of the above (4), the electric-current value of the pad motor can be preset taken into consideration the state of the floor-surface, namely, state of application of the wax, degree of dirtiness, etc. By doing this, the floor-surface can be polished with a suitable pad pressure (drawing force) depending on the state of the floor-surface to be polished.

As seen from the foregoing, the present invention can solve the above-mentioned problems inherent in the conventional devices by use of the various means mentioned above.

The above and other objects, characteristic features and advantages of the present invention will become more apparent to those skilled in the art by the following description of the preferred embodiment of the invention, as illustrated in the accompanying drawings.

DETAILED DESCRIPTION OF THE EMBODIMENT

One preferred embodiment of a floor-surface polisher equipped with a function for adjusting a pad pressure according to the present invention will now be described in detail with reference to the accompanying drawings. It should be noted that the preferred embodiment herein described is not intended to be exhaustive or to limit the invention to the precise form disclosed. It is chosen and described to explain the principles of the invention, its application and its practical use to enable others skilled in the art to utilize the invention.

Figure 1:
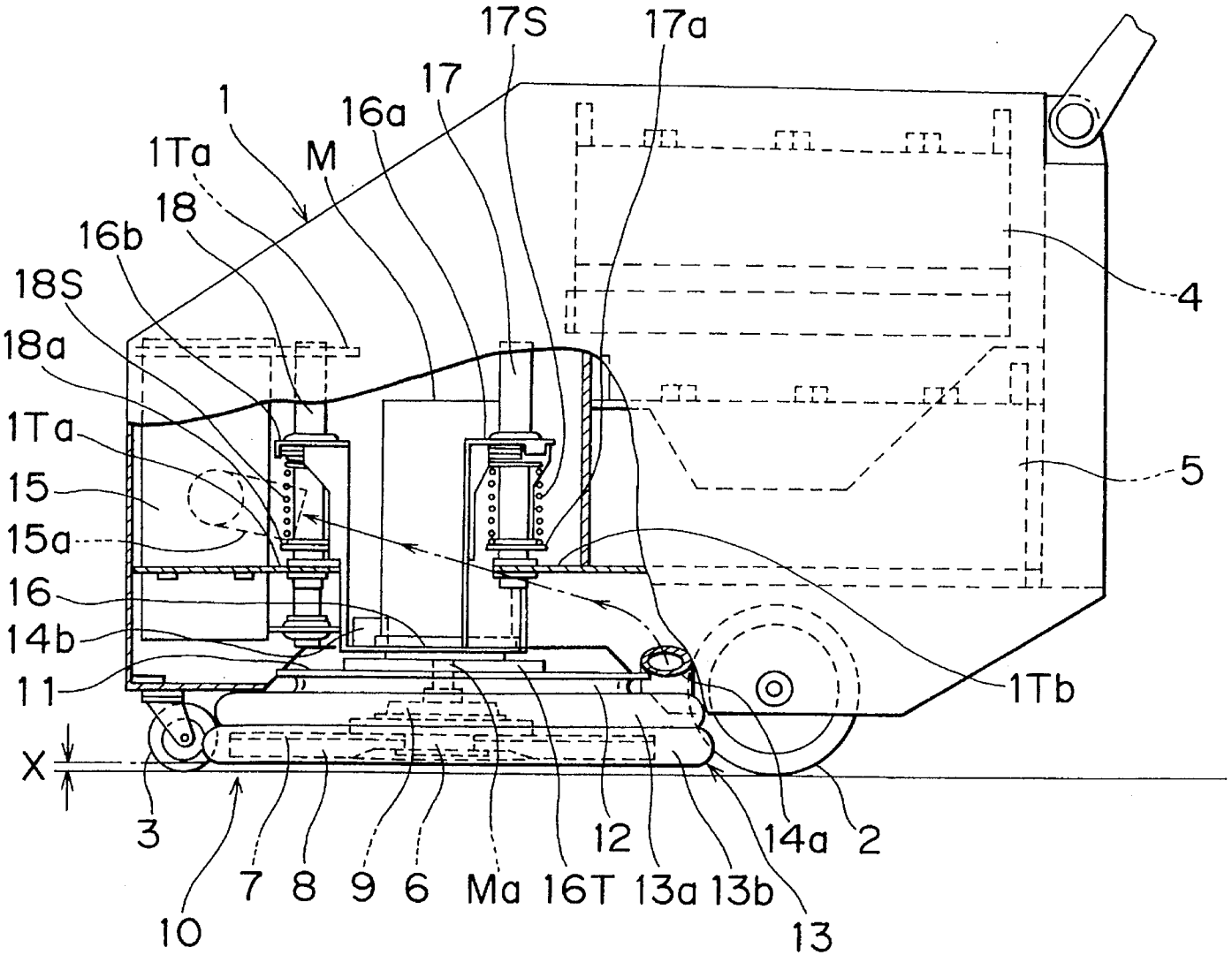
FIG. 1 is a side view of a floor-surface polisher equipped with a function for adjusting a pad pressure according to one embodiment of the present invention, in which an important portion thereof is shown in cross-section.

FIG. 1 is a side view of a floor-surface polisher equipped with a function for adjusting a pad pressure according to the present invention, in which an important portion thereof is shown in cross-section. In FIG. 1, reference numeral 1 denotes a machine body of a floor-surface polisher; 2 and 3, traveling wheels; 4 and 5, batteries as a power source loaded within the machine body 1; M, a motor as a driving source for a pad; Ma, a rotary shaft of the motor M; 8, a pad to be rotated at a high speed by the motor M; and 7, a pad mounting base for mounting the pad 8 on the rotary shaft Ma of the motor M, respectively.

Figure 2:
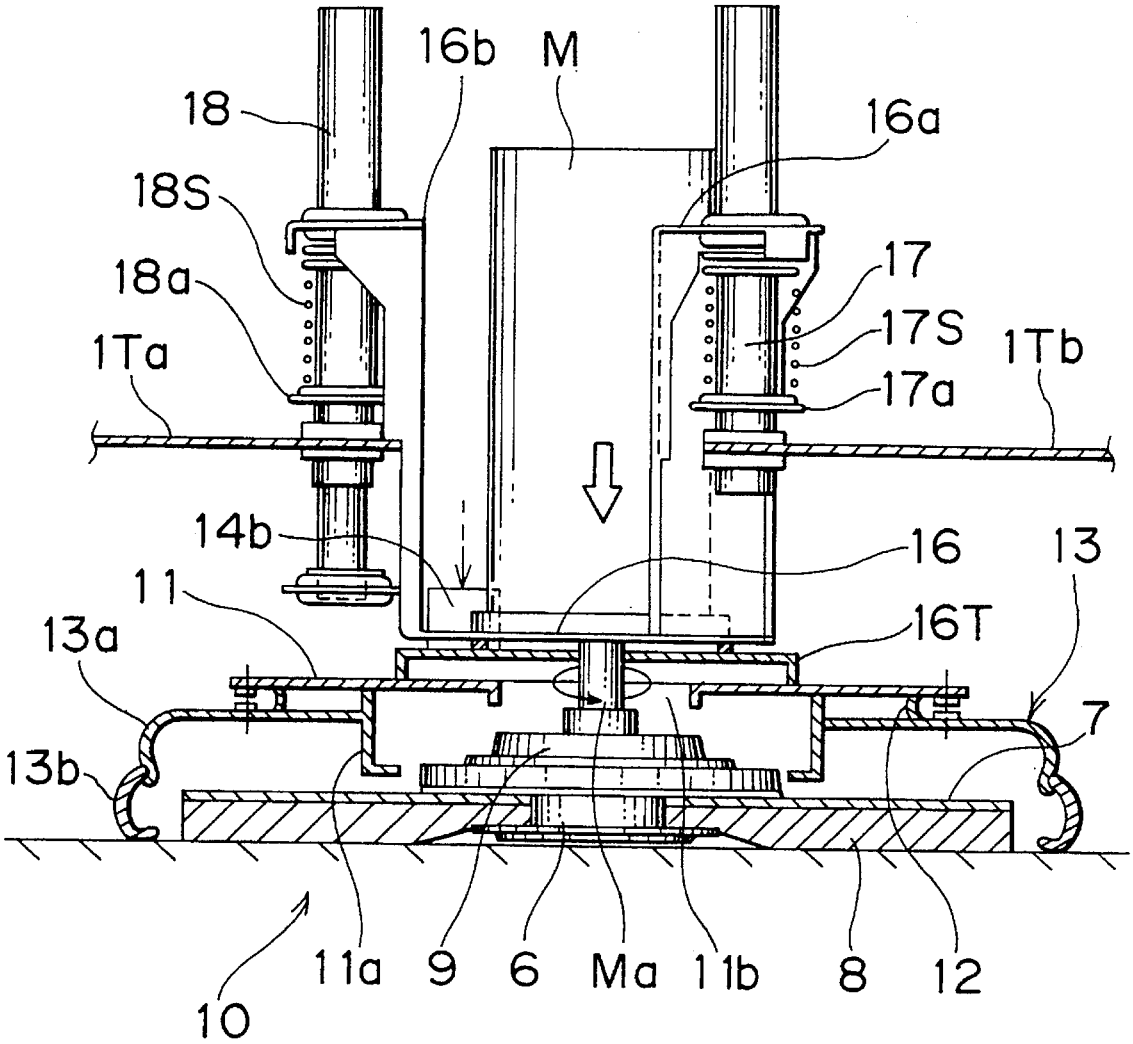
FIG. 2 is a cross-sectional view, showing an important portion of the present invention on an enlarged scale.

FIG. 2 is a front cross-sectional view for explaining a construction of the pad 8, a support portion and a mounting portion for it. In FIG. 2, as well as FIG. 1, reference numeral 10 generally denotes a rotary mechanism of the pad 8. The rotary shaft Ma extends downwardly from a shaft hole of a base 16T mounted on an upper surface of a base frame 11 through a ventilation hole 11*b* of the frame 11. A fan 9 is mounted on an upper surface of the pad mounting base 7, and a central portion of the fan 9 is firmly secured to a lower end portion of the rotary shaft Ma by means of a screw 6.

Reference 13 denotes a pad cover mounted on a bottom side of the fixing frame 11 through an expansible bellows 12, and 13*b* denotes a skirt portion which is made of soft rubber, the skirt portion 13*b* being removably attached to a lower portion of the pad cover 13 by fitting a mounting edge formed on an upper edge of the skirt portion 13*b* to a fitting portion formed on a lower edge of an outer periphery of an outer peripheral portion 13*a* of the pad cover 13. A rotary chamber is defined by the pad cover 13 and the skirt portion 13*b*. Within this rotary chamber, the pad 8 can be rotated at such a high speed as about 2,000 rpm by the motor M.

Reference numeral 11*a* denotes a guide cover frame. The guide cover frame 11*a* is mounted on the bottom of the base frame 11 in such a manner as to surround the periphery of the fan 9. A nozzle (not shown) is formed on an outer side of the guide cover frame 11*a*. This nozzle is adapted to jet a circulating air-stream produced by rotation of the fan 9 to an inner wall surface of the pad cover 13 at a predetermined angle and in the form of a compressed jet stream. Therefore, the air-stream produced by each vane of the fan 9 is vigorously circulated along the inner wall surface of the pad cover 13 while entangling dusts therein.

In FIG. 1, reference numeral 15 denotes a paper pack filter. The paper pack filter 15 is replaceably mounted within an exclusive box placed within the machine body 1. This filter 15 has an inlet port 15*a*. The inlet port 15*a* side of the filter 15 is connected to an air-sending port 14*a* open to an area one-sided to the edge of an upper surface of the pad cover 13 through a duct or hose. An outlet port (not shown) side of the filter 15 is connected to an air-intake port 14*b* formed on and projecting from an area one-sided to the center of an upper surface of the base 16T likewise through a duct or hose. In this way, the inside of the pad cover 13 and the filter 15 are connected to each other by a so-called circulating path.

In FIG. 1, reference numeral 16 denotes a mounting frame. The mounting frame 16 is adapted to normally support the motor M with a support force upwardly directed. Support plates 16*a* and 16*b* of the frame 16 are upwardly and downwardly movably supported by three support posts 17 and 18 (a third one is omitted) which are mounted on the fixing frame 1T*a* respectively through springs 17S and 18S. The arrangement being such that when the pad 8 is rotated at a high speed by rotation of the motor M, the pad 8 can be lowered to a position as shown in FIG. 2 together with the motor M and the pad cover 13, against the biasing forces of the springs 17S and 18S, so that the pad 8 intimately contacting the floor-surface is rotated at a high speed. When the pad 8 is stopped in rotation by turning off the motor M, the pad 8, the motor M and the pad cover 13 can be lifted up again to the position of FIG. 1 (namely, position a distance X away from the floor-surface) under the effect of the resilient forces of the springs 17S and 18S.

In the present invention, the pad 8 is of a special structure having a plurality of very small spaces therein. This special structure of the pad 8 can be formed, for example, by entangling chemical fibers having a large strength such as, for example, polyester fibers and molding the same under pressure (i.e., compression molding), or by molding a chemical raw material into a sponge-like structure. Owing to this structural feature of the pad 8, when the pad 8 is rotated at such a high speed as about 2,000 rpm by the motor M, air in each space is discharged outside to make the inside of the pad 8 negative in pressure. This negative pressure in the pad 8 exhibits the drawing force for drawing the pad 8 intimately to the floor-surface.

Figure 3:
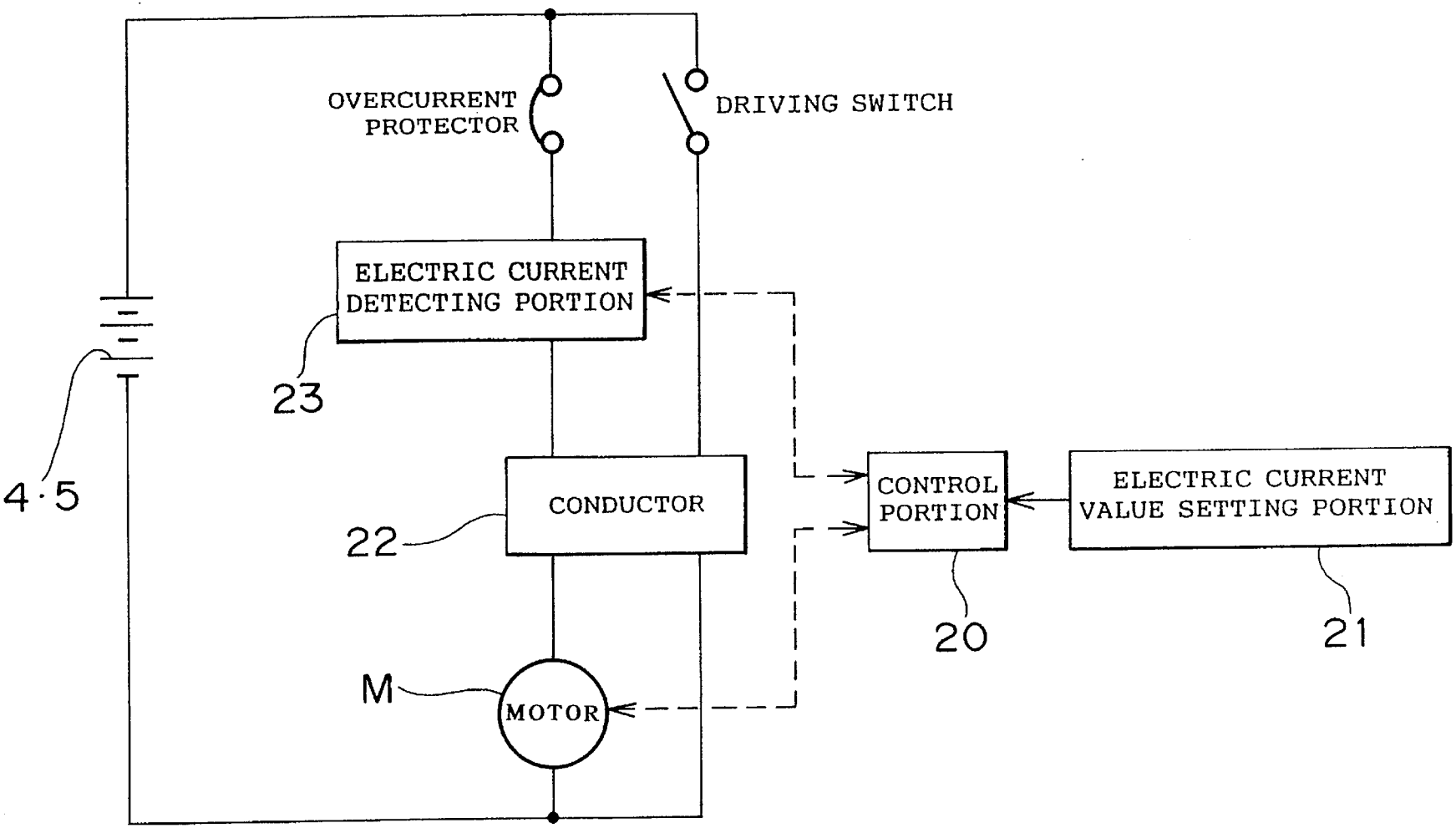
FIG. 3 is a block diagram for explaining an electric construction of a control device to be employed in the present invention.

FIG. 3 is a block diagram showing an electric construction of a control device which is built in the floor-surface polisher according to the present invention. In FIG. 3, reference numerals 22 and 23 respectively denote a conductor and an electric current detecting portion which are connected in a series between the pad motor M and an overcurrent protector. Similarly, reference numeral 20 denotes a control portion for automatically adjusting an electric current value of the motor M to a pre-set value by comparing an electric current value detected by the electric current detecting portion 23 with an electric current value (pre-set value), and 21 denotes an electric current value setting portion capable of optionally setting the pre-set value of the electric current. Therefore, according to this control device, the pad motor M can be driven always by a pre-set electric current value in accordance with a program of the control portion 20.

Figure 4:
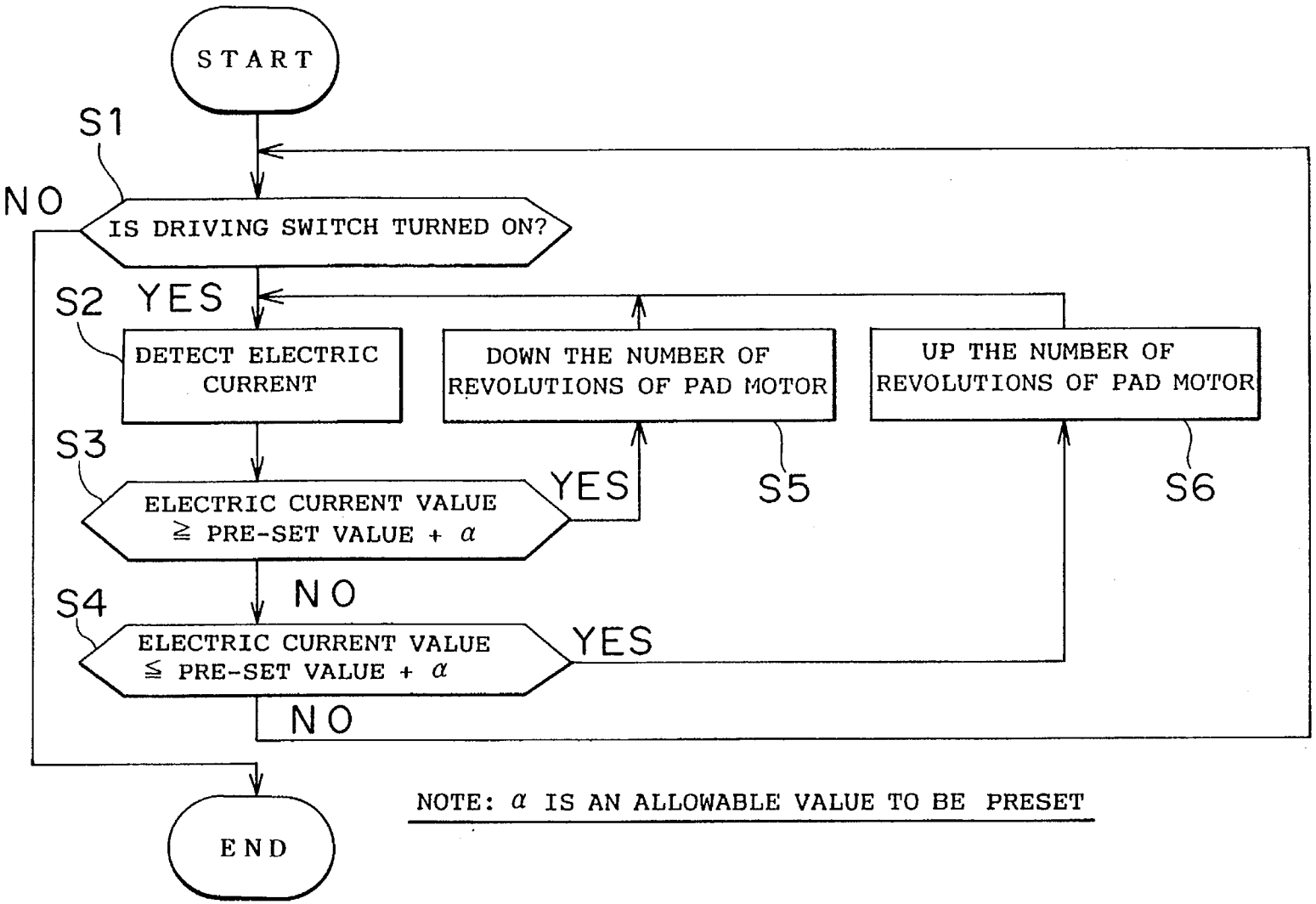
FIG. 4 is a flowchart showing the steps for controlling an electric current of a pad motor.

FIG. 4 is a flowchart for explaining the procedure for controlling the electric current of the pad motor M by the above-mentioned control device. In the first step S1, when a driving switch (not shown) mounted on the machine body 1 is turned on, the electric current detecting portion 23 detects the electric current value of the motor M in the next step S2 and then the program proceeds to following step S3. Before starting the operation, the electric current setting portion 21 is operated to set the electric current value of the pad motor M to a predetermined level with reference to the state of the floor-surface, and the like.

In step S3, the detected electric current value is compared with the pre-set electric current value. If the detected electric current value is equal to or larger than the pre-set value, the program proceeds to step S5 where after the number of revolutions of the motor M is downed by one (1) level by lowering the electric current value of the pad motor M by one (1) level through electric current control, the program returns back to the step S2. If not, the program proceeds directly to step S4.

In step S4, the detected electric current value and the pre-set value are likewise compared again with each other. If the detected electric current value is equal to or smaller than the pre-set value, the program proceeds to step 6 where the electric current value of the pad motor M is increased by one (1) level through electric current control and thereafter the program returns again to the step S2. If not, the program returns again to the step 1 where the procedure is repeated all over again. Therefore, according to the present invention, the pad motor M can be driven always with a pre-set electric current value without adversely affected by external factors such as wear of the pad 8, reduced voltage of the batteries 4, 5, state of the floor-surface, and the like.

Up/down of the electric current value of the pad motor M can be performed either by automatically increasing or decreasing the level, one-level by one-level, in accordance with the program of the control portion 20, or through the driver's manual operation of a dial, a switch, or the like (not shown) arranged on a control panel, etc. The automatic or manual adjustment can be selected in accordance with necessity (i.e., optional).

Since the floor-surface polisher equipped with a function for adjusting a pad pressure according to the present invention is constructed in the manner as mentioned above, when the machine body 1 is operated to travel while rotating the pad 8 at a high speed by the motor M, the floor-surface can be polished by the pad 8. Dusts produced within the pad cover due to high speed rotation of the pad 8, i.e., polishing operation are delivered from the air-sending port 14*a* into a paper pack filter 15 through a duct or hose. After the dusts are filtered there, the exhaust gas is circulated again back to the area one-sided to the center of the pad cover 13 through the duct or hose. By repeating this circulating operation, various dusts produced during the polishing operation can be gradually collected and caught by the paper pack filter 15.

Also, according to the present invention, in the case where the contact pressure (drawing force) of the pad 8 is lowered due to causes such as wear of the pad 8, or the like, the electric current detecting portion 23 detects the reduction of the electric current value of the pad motor M and the control portion 20 performs an up-control or up-instructions so that the electric current value will coincide with a pre-set value. Accordingly, since the drawing force of the pad 8 to the floor-surface, i.e., the pressing force of the pad 8 with respect to the floor-surface, can be restored to its original level by increasing the rotation of the pad 8 through level-up of the number of revolutions of the pad motor M, the polishing state can be returned to the reference state at the starting time of the operation.

As described in the foregoing, according to the floor-surface polisher equipped with a function for adjusting a pad pressure according to the present invention, when the pressing force (drawing force) of the pad to the floor-surface is reduced or weakened due to causes such as wear of the pad, reduction of voltage of the batteries, or the like, the pressing force can be restored to the original state by properly controlling the electric current value of the pad motor. Therefore, since the floor-surface can be polished always with a constant pressure, the overall floor-surface can be uniformly beautifully polished.

What is claimed is:

1. In a floor-surface polisher in which floor-surface is polished by a pad which is mounted within a pad cover and rotated at a high speed by a motor during the traveling operation of the polisher, a floor-surface polisher equipped with a function for adjusting pad pressure being characterized in that said pad is resiliently supported by a support force, said support force being biased in an upward direction to separate said pad away from the floor-surface, a plurality of very small spaces being formed within said pad so that a drawing force for lowering said pad toward the floor-surface against said biased upwardly-directing support force will be generated during a high speed rotation of said pad, means for adjusting an electric-current value of said motor to a pre-set value, said adjusting means being mounted on a control portion of said pad motor.

2. The floor-surface polisher equipped with a function for adjusting pad pressure as claimed in claim 1, in which said pad to be rotated at a high speed by said motor is upwardly resiliently supported by pad support means using selected one of a spring pressure, a hydraulic pressure, a pneumatic pressure, and a weight.

3. The floor-surface polisher equipped with a function for adjusting pad pressure as claimed in claim 1, in which said pad to be rotated at a high speed by said motor is formed into a construction in which a plurality of very small spaces exist within said pad.

4. The floor-surface polisher equipped with a function for adjusting pad pressure as claimed in claim 1, in which an electric-current value setting portion capable of setting an electric-current value of said motor is mounted on said control portion of said pad motor for rotating said pad at a high speed.

* * * * *